US005121608A

United States Patent [19]

Willis et al.

[11] Patent Number: 5,121,608

[45] Date of Patent: Jun. 16, 1992

[54] GAS TURBINE ENGINE FUEL BURNER

[75] Inventors: Jeffrey D. Willis, Coventry; Norman E. Deacon, Rugby; Richard E. Pollard, Coventry; Ian J. Toon, Leicester; Bernard W. Boyce, both of Leicester, all of England

[73] Assignee: Rolls-Royce plc, London, England

[21] Appl. No.: 478,026

[22] Filed: Feb. 9, 1990

Related U.S. Application Data

[63] Continuation-in-part of Ser. No. 305,200, Feb. 2, 1989, abandoned.

[30] Foreign Application Priority Data

Feb. 6, 1988 [GB] United Kingdom ..... 8802717
Feb. 6, 1988 [GB] United Kingdom ..... 8802718

[51] Int. Cl.[5] ..... F23R 3/36

[52] U.S. Cl. ..... 60/737; 60/738; 60/740; 60/743; 239/424

[58] Field of Search ..... 60/737, 738, 740, 742, 60/743, 747, 748, 749; 239/419, 423, 424, 434.5

[56] References Cited

U.S. PATENT DOCUMENTS

| | | | |
|---|---|---|---|
| 3,724,207 | 4/1973 | Johnson | 60/743 |
| 3,906,718 | 9/1975 | Wood | 60/743 |
| 3,980,233 | 9/1976 | Simmons et al. | 239/424 |
| 4,170,108 | 10/1979 | Mobsby | 60/740 |
| 4,171,091 | 10/1979 | van Hardeveld et al. | 239/424 |
| 4,327,547 | 5/1982 | Hughes et al. | 60/742 |
| 4,337,618 | 7/1982 | Hughes et al. | 60/742 |
| 4,373,325 | 2/1983 | Shelketon | 60/748 |
| 4,463,568 | 8/1984 | Willis et al. | 60/742 |
| 4,713,938 | 12/1987 | Willis | 60/748 |
| 4,893,475 | 1/1990 | Willis | 60/743 |

FOREIGN PATENT DOCUMENTS

| | | |
|---|---|---|
| 1427146 | 9/1972 | United Kingdom . |
| 2102936 | 7/1981 | United Kingdom . |

*Primary Examiner*—Louis J. Casaregola
*Assistant Examiner*—Timothy S. Thorpe
*Attorney, Agent, or Firm*—Cushman, Darby & Cushman

[57] ABSTRACT

A gas turbine engine fuel burner suitable for burning diesel fuel oil comprises an annular body and a center body coaxially located within the annular body so that an annular flow path is defined between them. At the upstream end of the burner an annular fuel manifold cooperates with the annular body and the center body to define two coaxial passages which direct air into the annular flow path with minimal turbulence. The low level of turbulence within the fuel burner reduces the possibility of spontaneous combustion occurring within the burner. The center body is hollow and is provided at its downstream end with an end cap which cooperates with the downstream end of the annular body to define a radial fuel/air mixture outlet. Air directed into the interior of the center body provides transpiration cooling of the end plate center portion and is also directed via passages to provide an air flow over the radially outer extent of the downstream face of the end cap to provide cooling thereof and prevent the build-up of carbon thereon.

12 Claims, 3 Drawing Sheets

GAS TURBINE ENGINE FUEL BURNER

This is a continuation-in-part of application Ser. No. 305,200, filed Feb. 2, 1989, which was abandoned upon the filing hereof.

This invention relates to a gas turbine engine fuel burner.

Gas turbine engine fuel burners are known in which an annular array of fuel nozzles are configured so as to direct discrete jets of fuel on to the radially inner surface of an annular body so that the fuel flows along that surface. An end cap is provided at the downstream end of the annular body which is axially spaced apart from the downstream end of the annular body so that a gap is defined between them. Air, which in operation flows through the annular body, exhausts through the defined gap and, in so doing, atomises the fuel which has been directed on to and has flowed along the inner surface of that body. The resultant atomised fuel is then directed into the combustion chamber associated with the burner whereupon the fuel/air mixture is combusted. UK Patent Nos. 1427146 and 2102936 relate to fuel burners of this general configuration.

It has been found with fuel burners of this type that turbulent zones can be generated within the volume defined by the annular body when the burner is operating under high power conditions i.e. when the air delivered to the burner is at high pressure and temperature. These generated turbulent zones lead in turn to recirculation within the burner so that regions of low velocity fuel/air mixture are created. These regions of low velocity fuel/air mixture can in turn ignite spontaneously, thereby causing serious overheating of the burner. It has also been found with such fuel burners that there is a tendency for the end cap of the fuel burner to overheat and for carbon to build-up on the peripheral regions of the end plate.

It is an object of the present invention to provide a gas turbine engine fuel burner in which such turbulent zones are reduced to the extent that spontaneous ignition within the burner is substantially eliminated.

It is a further object of the present invention to provide a fuel burner having an end cap which is less prone to overheating and carbon build-up than has heretofore been the case.

According to the present invention, a fuel burner suitable for a gas turbine engine comprises an annular body defining a radially inner annular surface, the upstream end of which annular body is adapted, in operation, to receive an air flow, an annular fuel manifold positioned at the upstream end of said annular body so as to be coaxial with and at least partially within said annular body, said fuel manifold being adapted to direct fuel on to said annular surface, and a circular cross-section center body, at least a major portion of which is located coaxially within said annular body and generally downstream of said fuel manifold so as to cooperate with said annular body to define an annular flow path through said burner, the downstream ends of said center body and said annular body being so configured as to cooperate to define a generally radially directed annular outlet for said annular flow path, the upstream ends of said center body and annular body cooperating with at least part of said fuel manifold to define two coaxial passages for the direction of said air flow into said annular flow path through said burner.

In a further embodiment of the invention, the downstream end of said annular body is provided with an end plate comprising a peripheral portion having a generally downstream facing surface and a center portion. A portion of said air flow operationally flowing through said annular body is directed to provide cooling of said end plate center portion. An airflow over at least the radially outer extent of said downstream surface of said peripheral portion provides cooling thereof and the inhibition of the formation of carbon thereon.

The invention will now be described, by way of example, with reference to the accompanying drawings, wherein like reference numbers designate like components.

Figure 1:
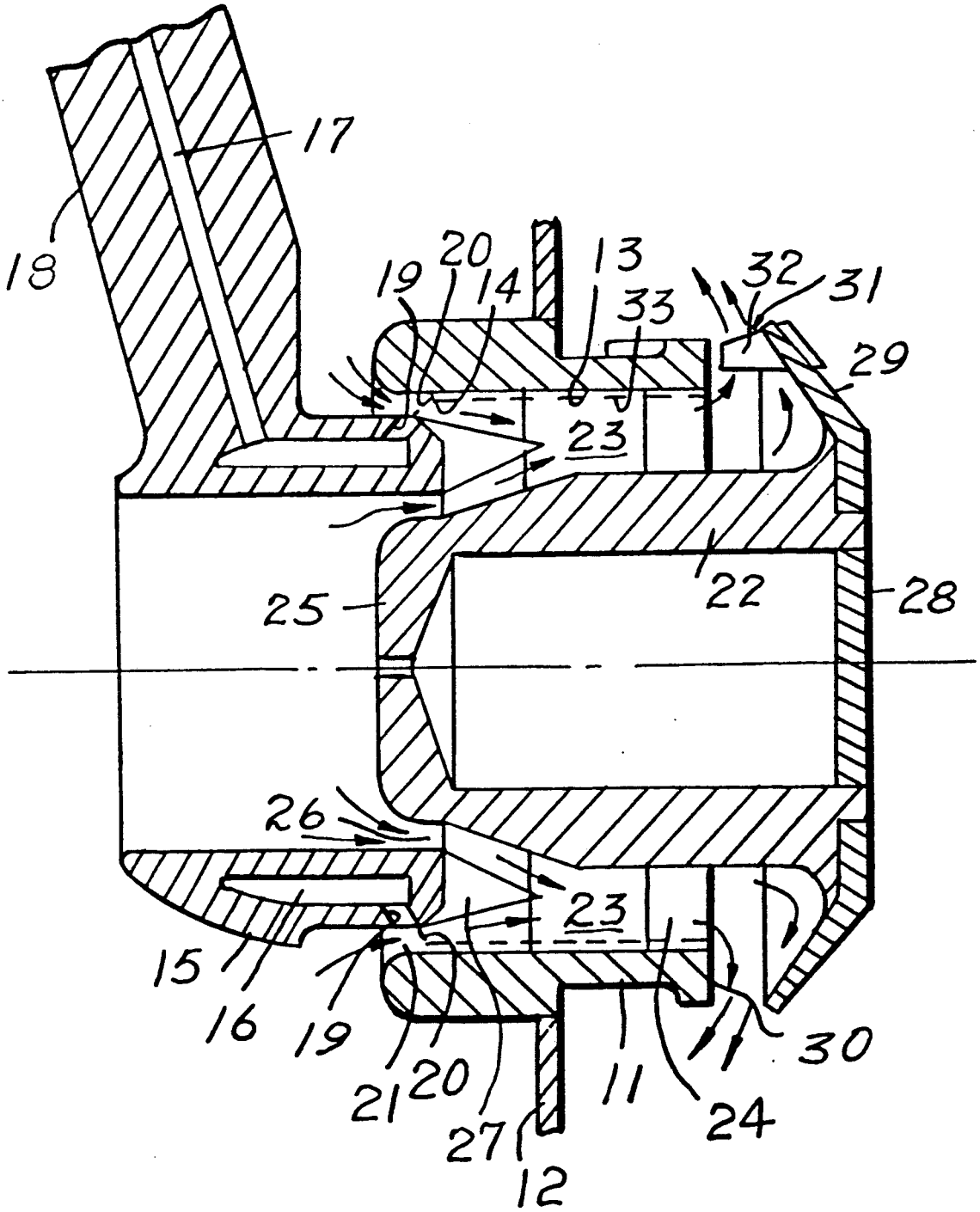
FIG. 1 is a sectioned side view of a fuel burner in accordance with the present invention.

FIG. 1 shows a fuel burner generally indicated at 10 suitable for a gas turbine engine (not shown). The fuel burner 10 comprises an annular body 11 which is, in operation, attached to the upstream wall, or head 12 of a conventional gas turbine engine combustion chamber (not shown).

The annular body 11 defines a radially inner annular surface 13 on to the upstream region 14 of which is directed a plurality of jets of fuel from an annular axially elongate fuel manifold 15. The fuel manifold 15 is of smaller diameter than the annular body 11 and includes an annular chamber 16 which is fed with fuel via a fuel supply passage 17 provided within an arm 18 supporting the manifold 15. The fuel manifold 15 is located coaxially with and upstream of the annular body 11 to the extent that a portion of the downstream end of the fuel manifold 15 extends into the annular body 11 so that an annular passage 21 is defined between them. A plurality of small nozzles 19 are provided in the fuel manifold 15 to interconnect the annular chamber 16 with the annular gap 21 and thereby operationally define the jets of fuel, which are indicated by the interrupted lines 20. The fuel jets 20 therefore pass across the annular passage 21.

The annular body 11 carries a generally circular cross-section hollow center body 22 via a plurality of radially extending aerodynamic struts 23. The majority of the center body 22 is coaxially located within the annular body 11 so that an annular flow path 24 is defined between them. The upstream end 25 of the center body 22 is of smaller diameter than the remainder thereof so as to permit that end 25 to locate coaxially within the downstream end of the fuel manifold 15. The centre body upstream end 25 is of smaller diameter than the fuel manifold 15 so that a second annular passage 26 is defined between them which is coaxial with and of generally similar cross-sectional area to the first annular passage 21.

The upstream end of the fuel burner 10 is, in operation, exposed to a flow of high pressure air delivered by the compressor of the gas turbine engine in which it is mounted. That air flow is divided into two flows by the fuel manifold 15: a first flow through the first radially outer annular passage 21, and a second flow through the second, radially inner annular passage 26. The two flows recombine downstream of the fuel manifold 15 to create a minor region of turbulence 27. However such turbulence is localised so that the majority of the air flow along the annular flow path 24 is non-turbulent.

The downstream end 28 of the center body 22 is provided with a generally frusto-conically shaped ring 29 at its periphery which cooperates with the downstream end of the annular body 11 to define a generally radially directed annular outlet 31 for the air flow along the annular flow path 24. Vanes 32 extend across almost the whole of the axial extent of the outlet 31 to ensure that the airflow remains non-turbulent in the region of the outlet 31. In the present embodiment, the air flow from the outlet 31 is directed in a slightly upstream direction. It will be appreciated, however, that the actual direction will depend upon the characteristics of the combustion chamber with which the fuel burner 10 is associated.

The fuel directed by the nozzles 19 on to the annular surface 13 flows along that surface 13 and, of course around the aerodynamic struts 23, in the form of a film as indicated by the interrupted lines 33. When that film of fuel reaches the downstream end of the annular body 11, it is atomised by the airflow exhausting from the outlet 31 and mixes with that airflow to place a combustible mixture within the combustion chamber with which the fuel burner 10 is associated.

It will be seen therefore that there is a minimal amount of turbulence within the fuel burner 10, thereby substantially reducing the risk of recirculation and therefore spontaneous combustion occurring within it.

Although in the present example, the center body 22 is shown as being attached to the annular body 11 by means of the aerodynamic struts 23, it will be appreciated that in certain circumstances the struts 23 could be deleted and the vanes 32 arranged to be connected to the downstream end of the annular body 11, thereby providing the necessary interconnection.

During the normal operating cycle of the fuel burner 10, thermal effects will result in the centre body 22 and the annular body 11 expanding and contracting axially at different rates. This is allowed for by ensuring that if the struts 23 are present, the vanes 32 do not physically interconnect the annular body 11 and the frusto-conical ring 29 on the centre body 22. There is a further problem however with such differing rates of expansion and contraction associated with the radially inner and outer annular passages 21 and 26. Thus in order to ensure that the cross-sectional areas of both of the radially inner and outer annular passages 21 and 26 remain constant the portions of the surfaces of the annular body 11, centre body 22 and fuel manifold 15 which serve to define those passages 21 and 26 are arranged to be generally parallel with each other. Such a maintenance of a constant cross-sectional area is important in ensuring a consistent air flow through the fuel burner 10 under all operating conditions.

Figure 2:
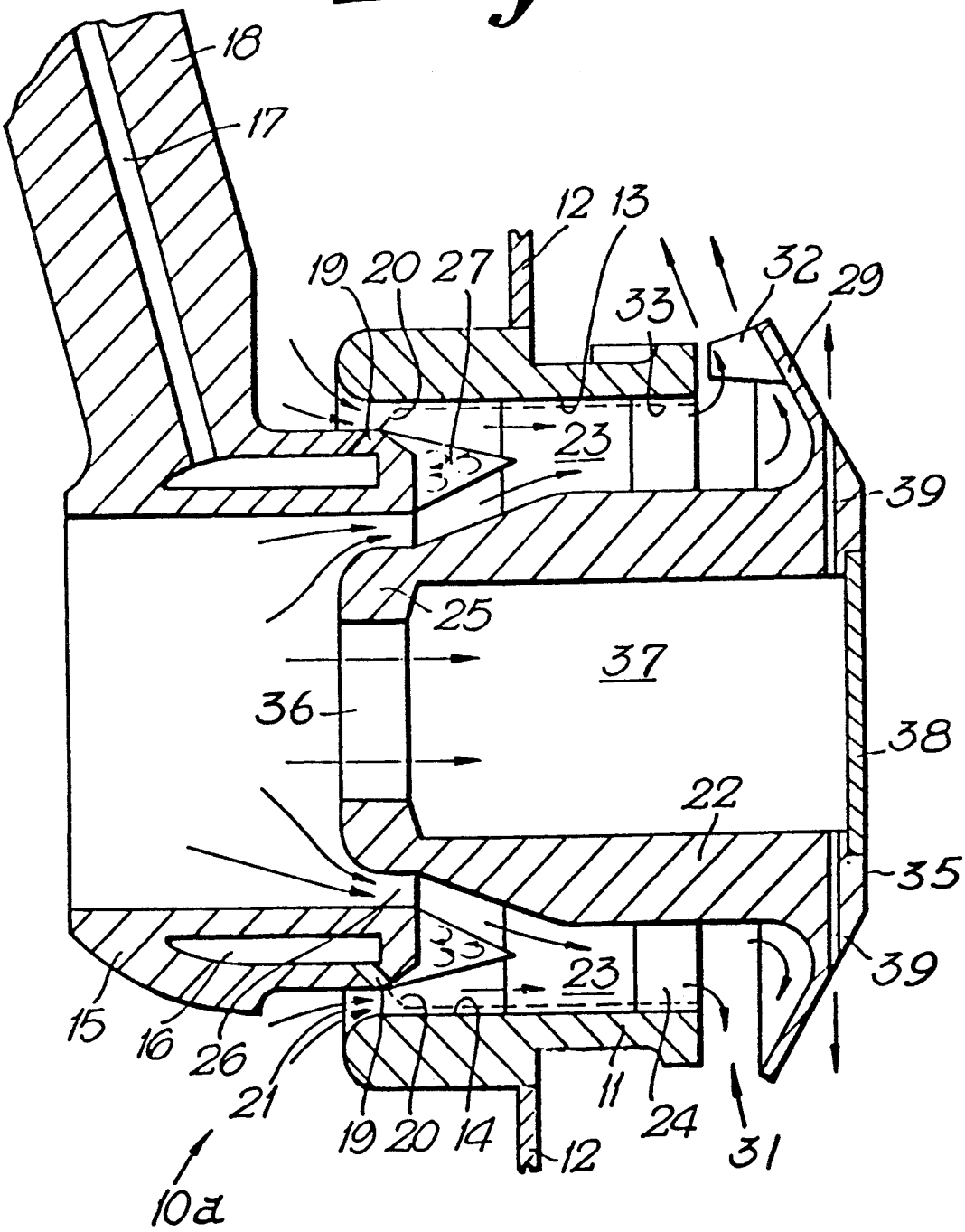
FIG. 2 is a sectioned side view of an alternative embodiment of a fuel burner in accordance with the present invention.
Figure 3:
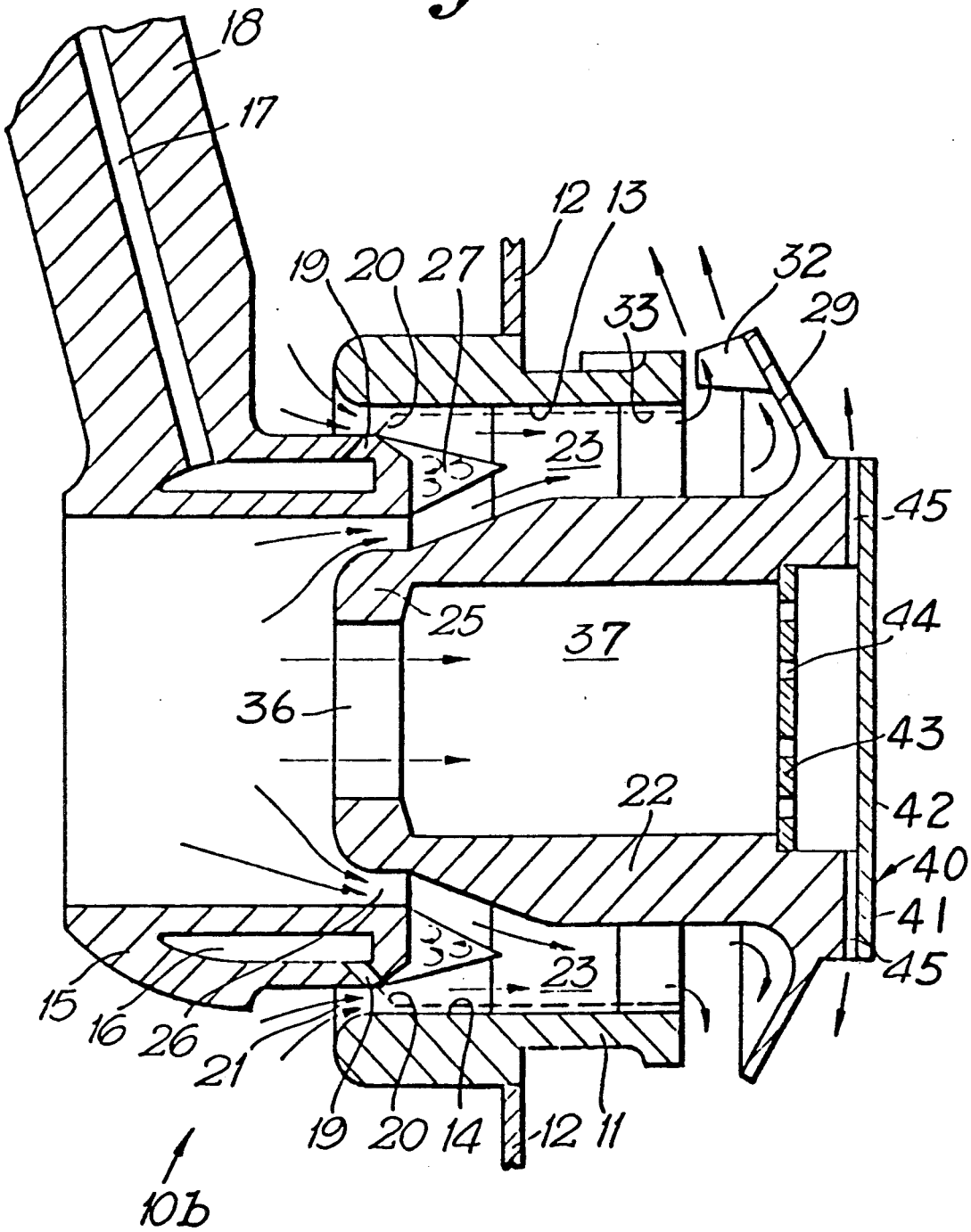
FIG. 3 is a sectioned side view of a further embodiment of a fuel burner in accordance with the present invention.

FIGS. 2 and 3 show alternative embodiments **10*a* and 10*b* respectively, of the fuel burner in which air flow through the fuel burner is divided into three flows by the fuel manifold 15, the annular body 11 and the center body 22. The first two flows are as discussed above and the third flow is through an orifice 36 provided in the upstream end 25 of the center body 22**.

FIG. 2 shows how the downstream end of the center body 22 is constituted by an end cap 35. The air flow through the orifice 36 and into an interior 37 of the center body 22 serves to provide cooling of the center portion of the 38 of the end cap 35, this being a region which in operation is particularly prone to overheating. The end cap center portion 38 is formed from a transpiration cooled material of the type described, for example, in UK Patent No. 2049152B.

Some of the air flow into the center body interior 37 flows through a plurality of radially extending passages 39 provided in the end cap 35. Each of the passages 39 interconnects the center body interior 37 with the downstream surface of the peripheral ring-shape portion 29 of the end plate 35. This ensures that some of the air from the center body interior 37 flows over the downstream surface of the end plate portion 29, thereby serving the dual role of providing cooling of the end plate portion 29 and inhibiting the formation of carbon build-up thereon.

FIG. 3 shows a further embodiment of the present invention in which a fuel burner **10*b* of generally similar configuration to that shown in FIG. 2 is provided with a different form of end cap. Those portions of fuel burner embodiment 10*b* shown in FIG. 3 which are common with those with the fuel burners 10 and 10*a* of FIGS. 1 and 2** respectively, are provided with common reference numerals.

The end cap 40 of the fuel burner **10*b* shown in FIG. 3 is constituted by an imperforate plate 41 which closes the downstream end of the center body 22 and defines the center portion 42 of the end cap 40. Immediately upstream of the center portion 42 of the end cap 40 and in axially spaced apart relationship therewith, there is provided an apertured plate 43. Air flowing into the center body interior 37 passes through the apertures 44 in the plate 43 to provide impingement cooling of the end cap center portion 42. The air then flows through a plurality of radially extending passages 45 provided in the end cap 40. As in the case of the embodiment of FIG. 2, each of the passages 45 interconnects the center body interior 37 with the downstream surface of the peripheral ring-shaped portion 29 of the end plate 40. The ring-shaped portion 29** is thus cooled and carbon is inhibited from forming on its surface.

Fuel burners 10 in accordance with the present invention are primarily intended to operate using diesel fuel oil as the fuel. It will be appreciated however, that other fuels could be utilised if so desired. It will also be appreciated that although the fuel burner embodiments shown in FIGS. 2 and 3 utilize an end cap center portion which is cooled by transpiration or impingement cooling, other forms of cooling could be utilized if appropriate.

We claim:

1. A fuel burner suitable for a gas turbine engine comprising an annular body defining a radially inner annular surface, the upstream end of which annular body is adapted, in operation, to receive an air flow, an annular fuel manifold positioned at the upstream end of said annular body so as to be coaxial with and at least partially within said annular body, and a circular cross-section center body, at least a major portion of which is located coaxially within said annular body and generally downstream of said fuel manifold to define an annular flow path through said burner, the downstream ends of said center body and said annular body being so configured as to cooperate to define a generally radially directed outlet for said annular flow path, the downstream end of said annular fuel manifold surrounding the upstream end of said center body so that the upstream ends of said center body and said annular body cooperate with the downstream end of said fuel manifold to define two coaxial passages of generally similar cross-sectional area for the direction of said air flow into said annular flow path through said burner with a minimum of turbulence of said air flow, said fuel manifold having a plurality of nozzles through which fuel is directed into the radially outer of the two coaxial passages and onto said annular surface.

2. A fuel burner as claimed in claim 1 wherein said fuel manifold is axially elongate.

3. A fuel burner as claimed in claim 2 wherein at least the upstream portion of said center body is of smaller external diameter than the internal diameter of at least the downstream portion of said fuel manifold, said upstream portion of said center body being located within said downstream portion of said fuel manifold in radially spaced apart relationship therewith so as to define one of said passages for the direction of said air flow into said annular flow path through said burner.

4. A fuel burner as claimed in claim 1 wherein said center body is connected to said annular body by a plurality of aerodynamic struts extending across said annular flow path.

5. A fuel burner as claimed in claim 1 wherein a plurality of flow directing vanes are provided in said generally radially directed outlet for said annular flow path.

6. A fuel burner as claimed in claim 1 wherein said two defined coaxial passages each have wall portions which are at least partially parallel so that any relative axial thermal growth in each of said annular body, fuel manifold and center body has a minimal effect upon the cross-sectional areas of said coaxial passages.

7. A fuel burner as claimed in claim 1 wherein the downstream end of said center body has a generally frusto-conical shaped periphery to provide an axially upstream component to said generally radially directed outlet for said annular flow path.

8. A fuel burner as claimed in claim 1 wherein said fuel is diesel fuel oil.

9. A fuel burner as claimed in claim 1 wherein said annular body is provided with an end cap located at the downstream end of said center body, said center body being hollow, said end cap comprising a peripheral portion having a generally downstream facing surface and a center portion, a portion of said air flow operationally flowing through said annular body being directed into said hollow center body to provide cooling of said end cap center portion, and an air flow over at least the radially outer extent of said downstream surface of said peripheral portion via a plurality of passages interconnecting the interior of said center body with the downstream face of said end cap to provide cooling of said radially outer extent of said downstream surface of said peripheral portion and the inhibition of the formation of carbon thereon.

10. A fuel burner as claimed in claim 9 wherein the total extents of said plurality of passages interconnecting the interior of said center body with the downstream face of said end cap are situated within said end cap.

11. A fuel burner as claimed in claim 9 wherein said end cap center portion is transpiration cooled.

12. A fuel burner as claimed in claim 10 wherein said end cap center portion is impingement cooled.

* * * * *